US005658197A

United States Patent [19]

Kil

[11] Patent Number: 5,658,197

[45] Date of Patent: Aug. 19, 1997

[54] AIR FLOW DIRECTION CONTROL BLADE FOR AN AIR CONDITIONER AND METHOD FOR ITS INSTALLATION

[75] Inventor: Yong Hyun Kil, Suwon, Rep. of Korea

[73] Assignee: Samsung Electronics Co., Ltd., Suwon, Rep. of Korea

[21] Appl. No.: 501,337

[22] Filed: Jul. 12, 1995

[30] Foreign Application Priority Data

Aug. 11, 1994 [KR] Rep. of Korea ..... 94-20297

[51] Int. Cl.[6] ..... F24F 13/14

[52] U.S. Cl. ..... 454/319; 454/313; 454/315

[58] Field of Search ..... 454/313, 315, 454/316, 318, 319, 321

[56] References Cited

U.S. PATENT DOCUMENTS 5,234,373 8/1993 Yamazaki et al. ..... 454/319

FOREIGN PATENT DOCUMENTS 251171 9/1912 Germany ..... 454/319

1-244242 9/1989 Japan ..... 454/315

*Primary Examiner*—Harold Joyce

*Attorney, Agent, or Firm*—Burns, Doane, Swecker & Mathis, L.L.P.

[57] ABSTRACT

An air conditioner includes a housing and a flow control blade mounted in an air discharge outlet of the housing. The blade is rotatable to various positions of adjustment about an axis defined by hinge pins of the blade mounted in hinge holes of the housing. A plurality of the hinge pins extend in the same direction and are of progressively different lengths so that when the blade is installed in the housing, the hinge pins can be successively inserted into their respective hinge holes; the need to simultaneously align all hinge pins with their hinge holes is avoided. A hinge pin disposed at one end of the blade extends in a direction opposite the other hinge pins and is inserted into an open end of a slot formed in the housing.

14 Claims, 4 Drawing Sheets

AIR FLOW DIRECTION CONTROL BLADE FOR AN AIR CONDITIONER AND METHOD FOR ITS INSTALLATION

BACKGROUND OF THE INVENTION

This invention relates to an air conditioner, and more particularly to an air flow direction control apparatus, of which the construction has been improved for easy attachment and detachment of the air flow direction control blades relative to a housing.

As shown in FIG. 1, a prior art air conditioner has air suction holes 10 and an air discharge opening 11 on the front of its outer case 1. In the outer case 1, an evaporator 12 is provided for cooling the room air, while a fan 13 is provided for discharging the cooled air. Adjacent to the air discharge opening 11, a first air flow direction control apparatus 14 is installed for controlling the flow direction of the cooled air in left and right directions and a second air flow direction control apparatus 15 is installed for controlling the flow direction of the cooled air in up and down directions.

In such an air conditioner, room air is introduced into the air conditioner through the air suction holes 10 by the operation of the fan 13, and then cooled by the evaporator 12. It is finally discharged into the room through the air discharge opening 11. At this time, the direction of the discharging air is controlled by the air flow direction control apparatuses 14 and 15.

FIG. 5 is an exploded perspective view showing a conventional air flow direction control apparatus 15. The air flow direction control apparatus 15 comprises first and second air flow direction control blades 20*a*, 20*b* which rotate in an up-and-down direction for controlling the air flow direction, and a housing 30 for receiving the air flow direction control blades 20*a*, 20*b*.

A plurality of hinge pins 21*a*, 22*a*, 23*a* are formed in a longitudinal direction at regular intervals on the inner wall of the first air flow direction control blade 20*a*. The hinge pin 21*a* on the right end of the blade 20*a* and the hinge pin 23*a* on the left end of the blade 20*a* extend outward away from the blade 20*a*, that is, in opposite directions to each other. The hinge pins 22*a* formed between the opposite ends of the blade 20*a* extend toward the left side of the blade 20*a*, as does the hinge pin 23*a*.

The second air flow direction control blade 20*b* also includes a plurality of hinge pins 21*b*, 22*b*, 23*b* similar in a similar manner to that of the first air flow direction control blade 20*a*.

In the air discharge opening 11, a plurality of brackets 31, 32, 33 are disposed perpendicularly to the blades 20*a*, 20*b* for rotatably supporting the blades 20*a*, 20*b*. Sets of hinge holes 41*a*, 41*b* and 42*a*, 42*b* and 43*a*, 43*b* are formed on the front edges of their respective brackets 31, 32, 33 for receiving the hinge pins 21*a*, 21*b* and 22*a*, 22*b* and 23*a*, 23*b* of the first and second air flow direction control blades 20*a* and 20*b*, respectively.

Accordingly, the first and second air flow direction control blades 20*a*, 20*b* are mounted on the housing 30 in such a manner that the hinge pins 21*a*, 22*a*, 23*a* of the first air flow direction control blade 20*a* are fitted into the hinge holes 41*a*, 42*a*, 43*a*, and the hinge pins 21*b*, 22*b*, 23*b* of the second air flow direction control blade 20*b* are fitted into the hinge holes 41*b*, 42*b*, 43*b*, respectively.

FIG. 6 shows the state of the hinge pins 21*a*, 22*a*, 23*a* in the first air flow direction control blade 20*a* after being fitted into the hinge holes 41*a*, 42*a*, 43*a*. The hinge pin 21*a* formed on the right end of the blade 20*a* is inserted into the hinge hole 41*a* towards the right side from the left inside wall of the bracket 31, while the other hinge pins 22*a*, 23*a* are inserted into the hinge holes 42*a*, 43*a* towards the left side from the right inside wall of their respective brackets.

The hinge pins 21*b*, 22*b*, 23*b* of the second air flow direction control blade 20*b* are fitted into the hinge holes 41*b*, 42*b*, 43*b* in the same manner as above.

However, in such a conventional air flow direction control apparatus, when the air flow direction control blades 20*a*, 20*b* are mounted in the housing 30, one side of the blades 20*a*, 20*b*, that is, the right side in FIG. 5, must be bent for insertion of the hinge pins in the hinge holes. This bending causes the assembling/disassembling works of the apparatus to be very inconvenient. This reason will be described in more detail below.

As shown in FIG. 6, the entire length VL of the blades 20*a*, 20*b* is longer by a distance 2 PL than the length BL between the brackets 31 and 33. Therefore, in order to mount the blade 20*a* in the housing 30, first of all, the right end of the blade 20*a* must be bent by at least a distance 2 PL to enable the hinge pins 22*a*, 23*a* to be aligned with the hinge holes 42*a*, 43*a* of the brackets 42, 43. The hinge pins 22*a*, 23*a* are then simultaneously inserted into their corresponding hinge holes 42*a*, 43*a* in a leftward direction. Finally, the hinge pin 21*a* is inserted into the hinge hole 41*a*.

Further, the blades 20*a*, 20*b* tend to easily get permanently bent out of shape because they are made from a flexible material like plastic. Accordingly, it is then difficult to align the hinge pins with the hinge holes, thereby causing troublesome assembling work.

Furthermore, after the first air flow direction control blade 20*a* has been mounted in the housing 30, the second air flow direction control blade 20*b* must also be assembled; however this must be done in a narrower air discharge opening 11 due to the presence therein of the blade 21*a*. Therefore, the assembling of the second blade 20*b* is more difficult.

The object of this invention is to provide an air flow direction control apparatus of an air conditioner, which can be easily and quickly assembled by improving the construction of the air flow direction control blade.

SUMMARY OF THE INVENTION

An air flow direction control apparatus according to this invention, which is mounted on the front of an air conditioner, comprises; at least one or more air flow direction control blades that include a plurality of vertical members and hinge pins arranged at regular intervals on the inner wall thereof for controlling the direction of the air discharge; a housing for receiving the air flow direction control blades; and a plurality of brackets which are arranged at identical intervals to those of the hinge pins and include a plurality of hinge holes for rotatably supporting the air flow direction control blades.

The one hinge pin of a fixed length, disposed on a first side end of the air flow direction control blade, extends outward from the vertical member. The other hinge pins extend outward from their respective vertical members toward the opposite direction of the extending direction of the one hinge pin, with the lengths of these respective hinge pins gradually increase at a fixed rate toward a second side end of the air flow direction control blade.

When the air flow direction control blade is fitted to the housing, the longest hinge pin formed on the second side end of the blade is first inserted into the corresponding hinge hole, and, secondly, the other hinge pins are sequentially inserted into their corresponding hinge holes until the shortest hinge pin formed on the first side end of the blade is finally inserted into the corresponding hinge hole.

Further, the hinge hole, which is formed on the bracket fitted to the first side end of the housing, is formed by cutting a groove downwards in the front edge of the bracket, so that the corresponding hinge pin can be pushed downwards into the grooved hinge hole after the other hinge pins have been sequentially inserted into their corresponding hinge holes, thereby giving ease in assembly work.

DESCRIPTION OF THE PREFERRED EMBODIMENT

Figure 2:
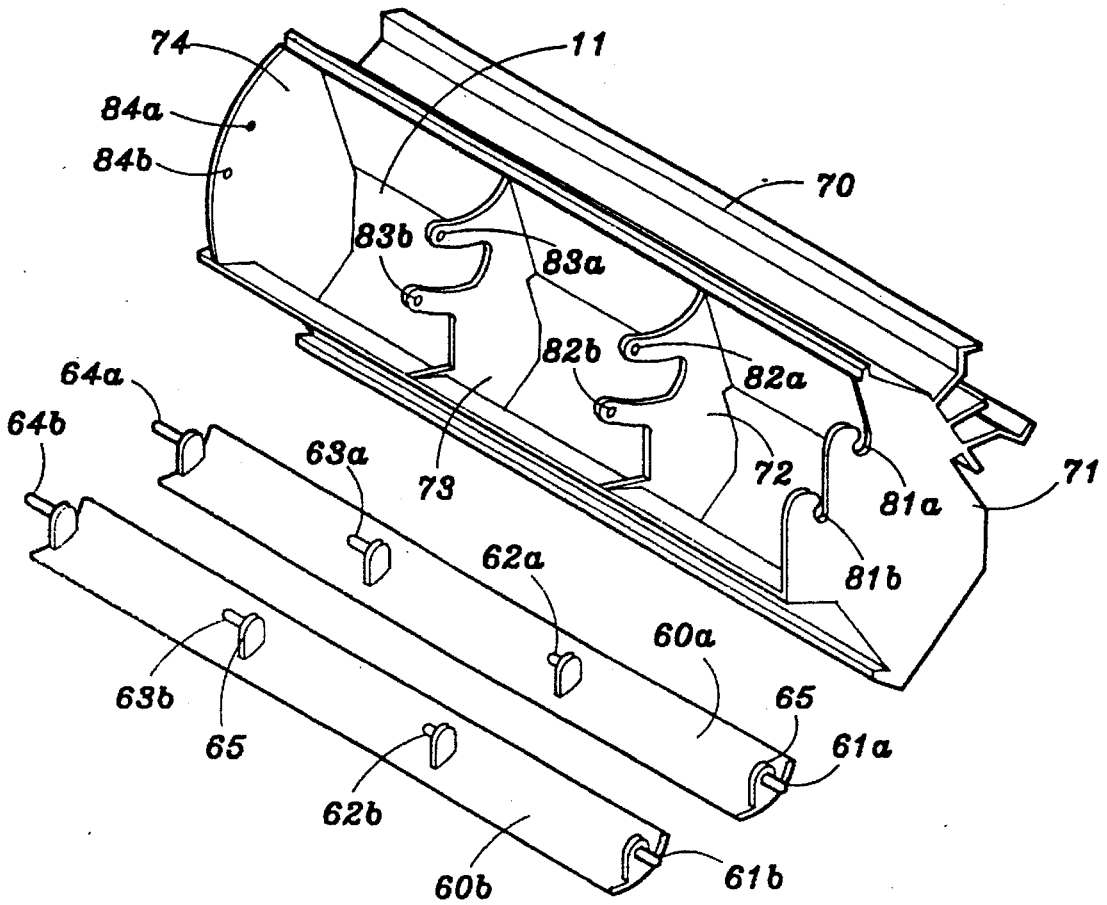
FIG. 2 is an exploded perspective view showing an air flow direction control apparatus according to this invention.

FIG. 2 illustrates an exploded perspective view of an air flow direction control apparatus according to this invention.

Figure 1:
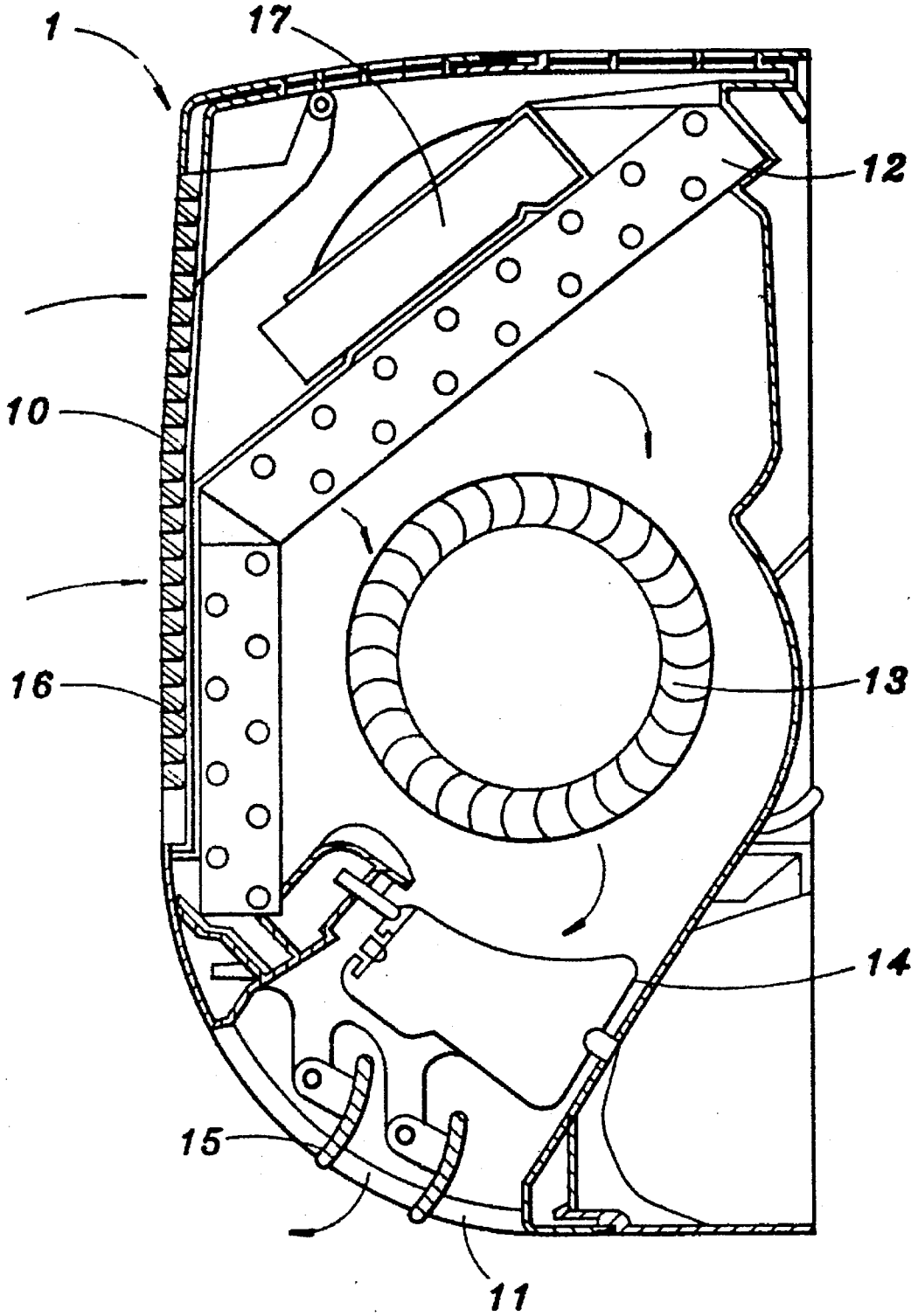
FIG. 1 (Prior Art)
FIG. 1 is a vertical sectional view of a prior art air conditioner to which this invention has been adapted.

The air flow direction control apparatus, which is mounted on the front of an air discharge opening 11 of the type shown in FIG. 1, comprises first and second air flow direction control blades 60*a*, 60*b* for controlling the flow direction of cooled air, and a housing 70 for receiving these blades 60*a*, 60*b*.

A plurality of ear members 65 are mounted at regular intervals on the inner wall of the first air flow direction control blade 60*a*. Hinge pins 61*a*, 62*a*, 63*a* and 64*a* are fixed on their respective ear members 65 in a longitudinally spaced relationship along the air flow direction control blade 60*a*.

The hinge pins 61*a* and 64*a* extend outward from opposite ends of the blade 60*a*, that is, in opposite directions to each other. The other hinge pins 62*a* and 63*a*, which are disposed in between the opposite ends of the blade 60*a*, extend in a leftward direction identical to the hinge pin 64*a* on the left end, as shown in FIG. 2.

Figure 3:
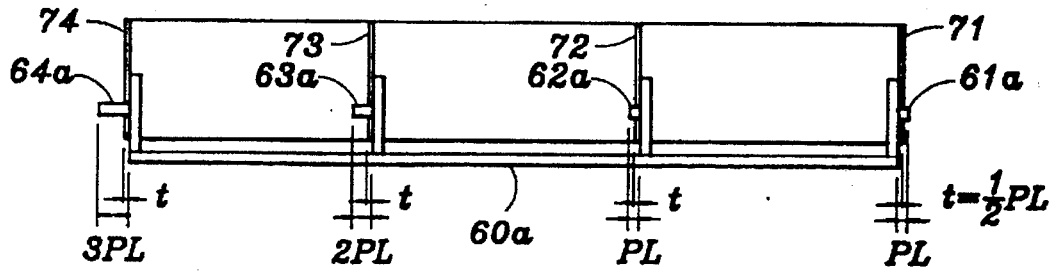
FIG. 3 is a horizontal sectional view showing the assembled state of the air flow direction control blade of FIG. 2 in a housing.

As a characteristic structure of this invention, the hinge pins 62*a*, 63*a* and 64*a* which extend in the same direction, sequentially increase in length, as shown in FIG. 3. That is, the hinge pins 62*a* to 64*a* are formed such that when the length of each of the hinge pins 61*a* and 62*a* is PL, the length of the hinge pin 63*a* is 2 PL, and the length of the hinge pin 64*a* formed on the left end of the blade 60*a* is 3 PL.

The above length ratio may be changed depending on the actual design condition. As shown in FIG. 2, the second air flow direction control blade 60*b* has an identical structure to that of the first air flow direction control blade 60*a*, and therefore an explanation of the second blade 60*b* will be omitted.

The front and rear portions of the housing 70 are open to form the air discharge opening 11. Brackets 71, 72, 73 and 74 are mounted in the same direction as the air flow in the air discharge opening 11. The brackets 71 and 74 are formed on opposite sides of the housing 70. The brackets 71 to 74 are arranged at identical intervals to that of the hinge pins 61 to 64 formed on the blades 60*a* and 60*b*.

In order to receive the respective hinge pins 61 to 64, hinge holes in the form of a set of cut portions slots 81*a* and 81*b* are formed in the bracket 71 mounted on the right end of the housing 70, and hinge holes 82*a* and 82*b*, 83*a* and 83*b*, 84*a* and 84*b* are formed in the brackets 72, 73 and 74, respectively. The slots 81*a* and 81*b* for the hinge pins 61*a* and 61*b* extend in a downwards slant from the front edge of the bracket 71. It is desired that the thickness (t) of each bracket be thinner than length PL of the shortest hinge pin 61 or 62. In this embodiment, the thickness (t) is designed as ½ PL.

With respect to the air flow direction control apparatus constructed as above, the method of mounting the first and second air flow direction control blades 60*a* and 60*b* in the housing 70 will be described below.

FIGS. 4A to 4D show in sequence the process of inserting the respective hinge pins 62*a*, 63*a* and 64*a* of the first air flow direction control blade 60*a* into their respective hinge holes 82*a*, 83*a* and 84*a* of the corresponding brackets 72, 73 and 74.

Here, the hinge pin 61*a*, disposed on the right end of the first air flow direction control blade 60*a*, is not included in FIG. 4 because its direction of insertion would not be discernable therein. That is, the hinge pin 61*a* will finally be inserted into its corresponding slot 81*a* in such a manner that it is pushed in a direction away from the viewer of FIG. 4 unlike the other pins 62*a*, 63*a* and 64*a*.

Figure 4A:
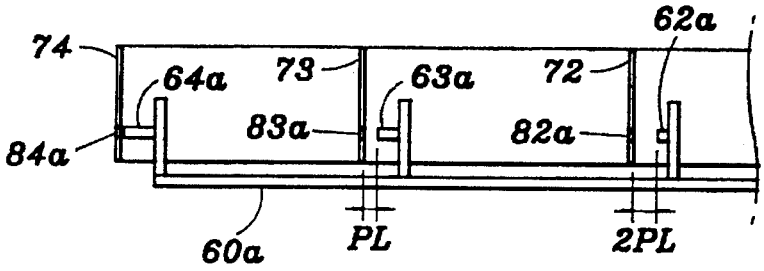
FIGS. 4A to 4D are views showing the sequence of steps for mounting the air flow direction control blades in a housing.

As shown in FIG. 4A, the hinge pin 64*a*, disposed on the left end of the first air flow direction control blade 60*a*, is first aligned with the corresponding hinge hole 84*a* of the bracket 74. In this state, the neighboring hinge pin 63*a* is a length PL away from the bracket 73 or hinge hole 83*a*, and the hinge pin 62*a* is a length 2 PL away from the bracket 72 or hinge hole 82*a*.

Figure 4B:
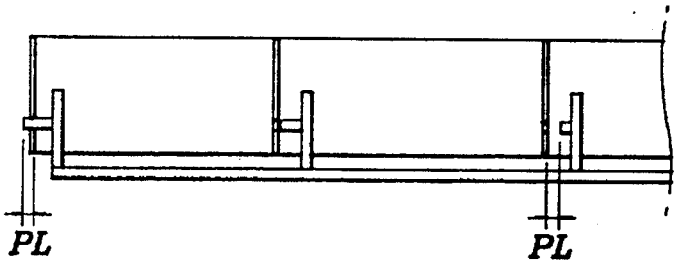

Next, as shown in FIG. 4B, the hinge pin 64*a* is inserted into the hinge hole 84*a* to a length PL, while the hinge pin 63*a* is positioned just to the right of the hinge hole 83*a*, and the hinge pin 62*a* is a length PL away from the hinge hole 82*a*.

Figure 4C:
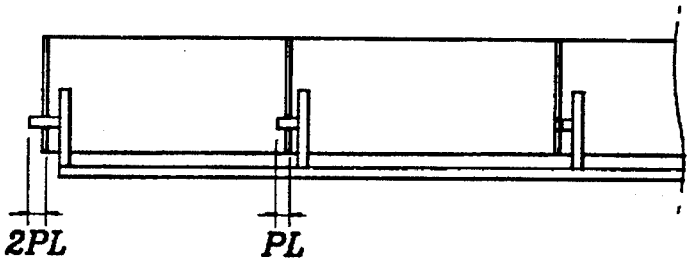
Figure 4D:
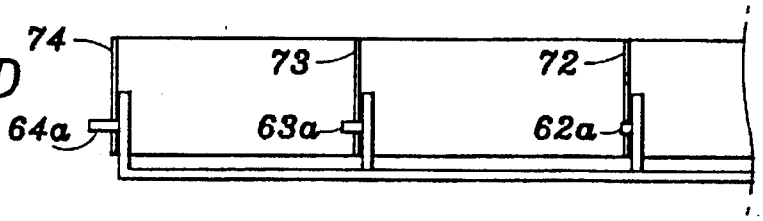
Figure 5:
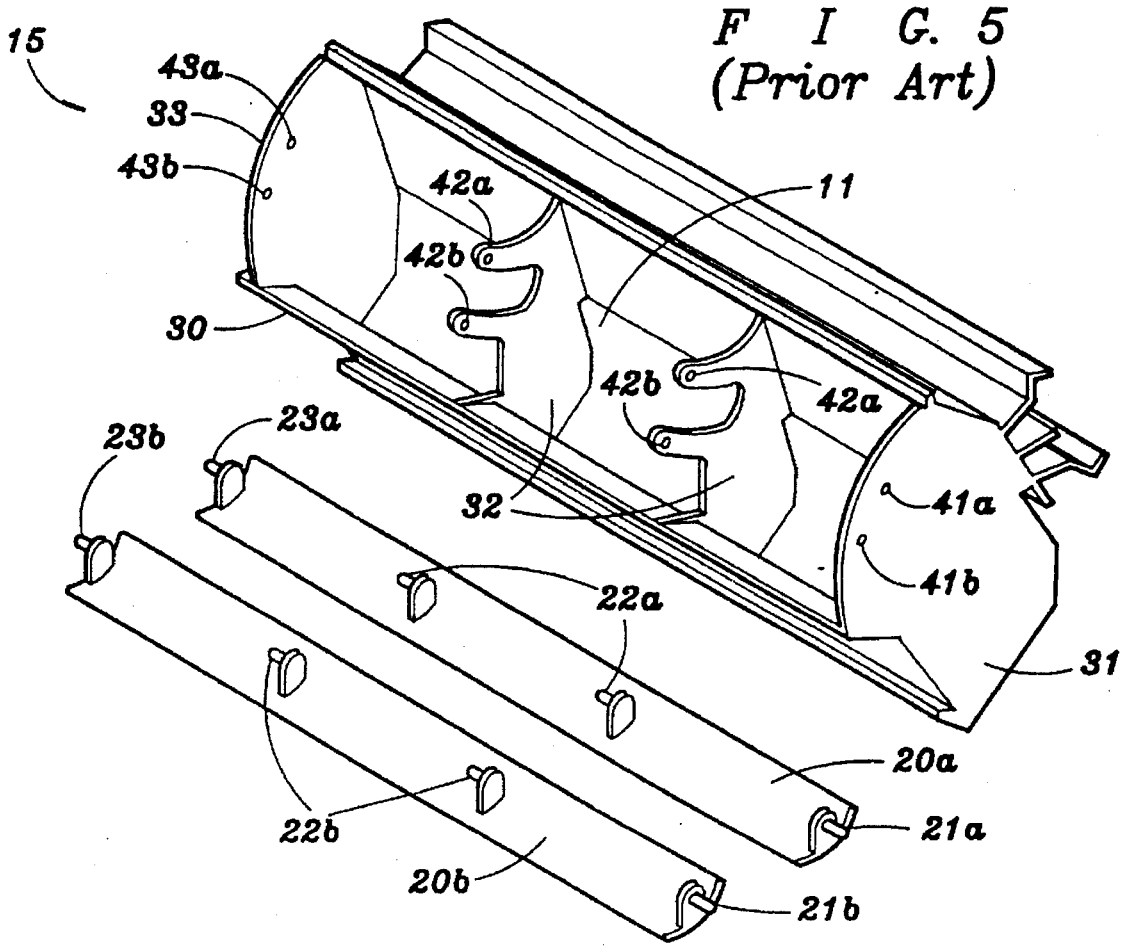
FIG. 5 (Prior Art)
FIG. 5 is an exploded perspective view showing a conventional air flow direction control apparatus.
Figure 6:
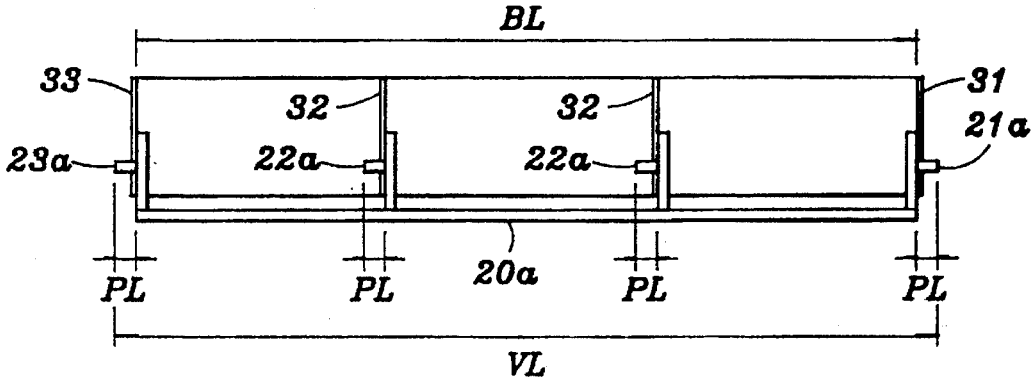
FIG. 6 (Prior Art)
FIG. 6 is a horizontal sectional view showing the conventional air flow direction control blade of FIG. 5 mounted in a housing.

Next, as shown in FIG. 4C, the hinge pin 63*a* is aligned with the hinge hole 83*a* and inserted into it to a length PL, while the hinge pin 64*a* has passed through the hinge hole 84*a* to a length 2 PL, and the hinge pin 62*a* is positioned just to the right of the hinge hole 82*a*.

Then, as shown in 4D, the hinge pin 62*a* is inserted into the hinge hole 82*a*. According to the sequential movements as above, the hinge pins 62*a*, 63*a* and 64*a*, facing the left side, are completely inserted into their respective hinge holes 82*a*, 83*a* and 84*a*.

Finally the hinge pin 61*a*, facing toward the right pushed downwards into the corresponding slot 81*a*, whereupon the assembling work of the first air flow direction control blade 60*a* is complete.

The assembling work of the second air flow direction control blade 60*b* is identical to that of the first air flow direction control blade 60*a*, and therefore further description will be omitted.

Even though this described embodiment involves an air flow direction control apparatus comprising only two air flow direction control blades and four brackets, this invention can be applied to an air flow direction control apparatus having several more air flow direction control blades or brackets.

Since the hinge pins extending in the same direction on an air flow direction control blade, are sequentially inserted into their corresponding hinge holes, it is not necessary to align and fit all the hinge pins to their respective hinge holes at the same time.

Further, since the cut portion, formed on the bracket 65 comprises a groove or slot extending from an edge of the bracket, the assembling of the pins 62*a*, 63*a*, 64*a* can be performed while the pin 61*a* extends through the slot, and there is never a need to bend the bracket 65 or one end of the air flow direction control blade.

As a consequence, the air flow direction control apparatus, according to this invention, is advantageous in that the air flow direction control blades can be mounted in the housing very easily and quickly.

What is claimed is:

1. A method of assembling a flow control blade member within an air discharge outlet of an air conditioner housing member so that the blade member can rotate between adjusted positions about an axis defined by aligned hinge pins mounted in aligned hinge holes, the hinge pins carried by one of said members, and the hinge holes disposed in the other of said members, said method comprising the steps of:

A. positioning said blade member to situate a plurality of said hinge pins adjacent associated hinge holes, and such that a first hinge pin of said plurality is located closer to an associated first hinge hole than a second hinge pin of said plurality is located with respect to an associated second hinge hole;

B. bringing said first hinge pin hole and said first hinge hole into mutual alignment;

C. displacing said blade member parallel to said axis to insert said first hinge pin into said first hinge hole, and to bring said second hinge pin closer to said second hinge hole;

D. bringing said second hinge pin and second hinge hole into mutual alignment; and E. displacing said blade member parallel to said axis to insert said second hinge pin into said second hinge hole.

2. The method according to claim 1 wherein said one member includes a third hinge pin extending in a direction opposite said first and second hinge pins, step A including positioning said third hinge pin into an open end of a hinge hole in the form of a slot formed in said other of said members.

3. The method according to claim 2 including, following step E, the step of pushing said third hinge pin to a closed end of said slot.

4. The method according to claim 1 wherein step A comprises positioning said blade member to situate a plurality of said hinge pins carried by said blade adjacent associated hinge holes disposed in said housing member.

5. The method according to claim 1 wherein step A comprises positioning said blade member such that said first hinge pin located at one end of said blade member, situated adjacent said first hinge hole, and said second hinge pin located intermediate opposite ends of said blade member is generally aligned with said second hinge hole.

6. The method according to claim 5 wherein said one member includes a third hinge pin extending in a direction opposite said first and second hinge pins, step A including inserting said third hinge pin into an open end of a slot formed in said other of said members.

7. The method according to claim 1 further including an additional hinge pin extending in the same direction as said first and second hinge pins, and further including, following step E, the steps of bringing said additional hinge pin and an associated hinge hole into mutual alignment, and thereafter displacing said blade member parallel to said axis to insert said additional hinge pin into its associated hinge hole.

8. In an air conditioner comprising a housing member forming an air discharge outlet, and a flow control blade member disposed in said discharge outlet and hingedly mounted to said housing for rotation about an axis defined by aligned hinge pins mounted in aligned hinge holes, said hinge pins carried by one of said members, and said hinge holes formed in the other of said members, a plurality of said hinge pins extending in the same direction along said axis, a first hinge pin of said plurality extending farther through its associated first hinge hole than a second hinge pin of said plurality extends with respect to its associated second hinge hole.

9. The air conditioner according to claim 8 wherein said blade member includes a third hinge pin lying on said axis and extending in a direction opposite said first and second hinge pins, one of said hinge holes being in the form of a slot open at one end, said third hinge pin disposed in said slot.

10. The air conditioner according to claim 9 wherein said hinge pins are carried by said blade member, and said hinge holes are formed in said housing member.

11. The air conditioner according to claim 10 wherein said first and third hinge pins are disposed at opposite ends of said blade member.

12. The air conditioner according to claim 11 wherein said housing member comprises brackets spaced apart in a direction of said axis and oriented transversely relative to said axis, said hinge holes formed in respective ones of said brackets.

13. The air conditioner according to claim 8 wherein said hinge pins are carried by said blade member, and said hinge holes are formed in said housing member.

14. The air conditioner according to claim 8 wherein said plurality comprises an additional hinge pin extending in the same direction as said first and second hinge pins, said second hinge pin extending farther than said third hinge pin extends with respect to its associated hinge hole.

* * * * *